US007861357B1

(12) United States Patent
Porter

(10) Patent No.: US 7,861,357 B1
(45) Date of Patent: Jan. 4, 2011

(54) O'BRUSH GRILL CLEANER

(76) Inventor: Kerry Porter, 14075 N. 106th Pl., Scottsdale, AZ (US) 85255

( * ) Notice: Subject to any disclaimer, the term of this patent is extended or adjusted under 35 U.S.C. 154(b) by 685 days.

(21) Appl. No.: 11/825,624

(22) Filed: Jul. 9, 2007

(51) Int. Cl.
*A47L 13/10* (2006.01)

(52) U.S. Cl. ..... 15/111; 15/160; 15/23; 15/210.1; 15/229.13

(58) Field of Classification Search ..... 15/237.07, 15/235.05, 111, 160, 23, 236.07, 236.05, 15/210.1, 229.12, 229.13; D4/132
See application file for complete search history.

(56) References Cited

U.S. PATENT DOCUMENTS 4,365,380 A 12/1982 Fassler
5,373,600 A 12/1994 Stojanovski et al.
6,443,646 B1 9/2002 MacDonald
6,745,428 B2 6/2004 MacLean
D502,323 S 3/2005 Zemel
7,621,234 B2 * 11/2009 Roy ..... 119/628

* cited by examiner

*Primary Examiner*—Shay L Karls

(57) ABSTRACT

A cleaning tool for grills and the like that provides multiple selective cleaning surfaces contoured for contact with the grill to be cleaned. A cleaning cylinder is rotatably mounted in a support handle frame so as to be indexed by rotation on a central axis by the user to position new contact cleaning surface areas for use.

3 Claims, 3 Drawing Sheets

O'BRUSH GRILL CLEANER

BACKGROUND OF THE INVENTION

1. Technical Field

This device relates to grill cleaning devices that are used to clean outdoor grill surfaces and the like typically found in gas or charcoal grills. Such devices normally have a brush surface made out of metal such as bronze or steel for cleaning the grill grates as well as a scraper and sometimes a cleaning pad of steel wool on its reverse side.

2. Description of Prior Art

A number of grill brush designs have been developed for cleaning the grill grate surfaces of cooking debris associated with grill cooking. Such prior art brushes address various issues associated with grill surfaces, see for example U.S. Pat. Nos. 4,365,380, 5,373,600, 6,443,646, 6,745,482 and D502, 323S.

In Patent ending in 428, a disposable brush portion is disclosed in which a brush head is removably mounted on a handle that can be replaced after extended use.

Patent ending in 380 claims a brush cleaning tool for grills in which multiple bristle elements are of different lengths positioned so as to better engage about the surface of the grate elements on the grill during cleaning.

In U.S. Patent ending in 646 a grill brush is scene having an oil dispensing container to dispense cleaning oil as it is used on the grill.

SUMMARY OF THE INVENTION

A grill brush cleaning device providing a cleaning wheel having a contoured grooved surface covered with steel scrubbing elements that can be rotated to apply different areas thereof to the grill surface. A mounting and indexing assembly supports and allows for selective rotation of the cleaning wheel in the holder for improved and extended use.

DETAILED DESCRIPTION OF THE INVENTION

Figure 1:
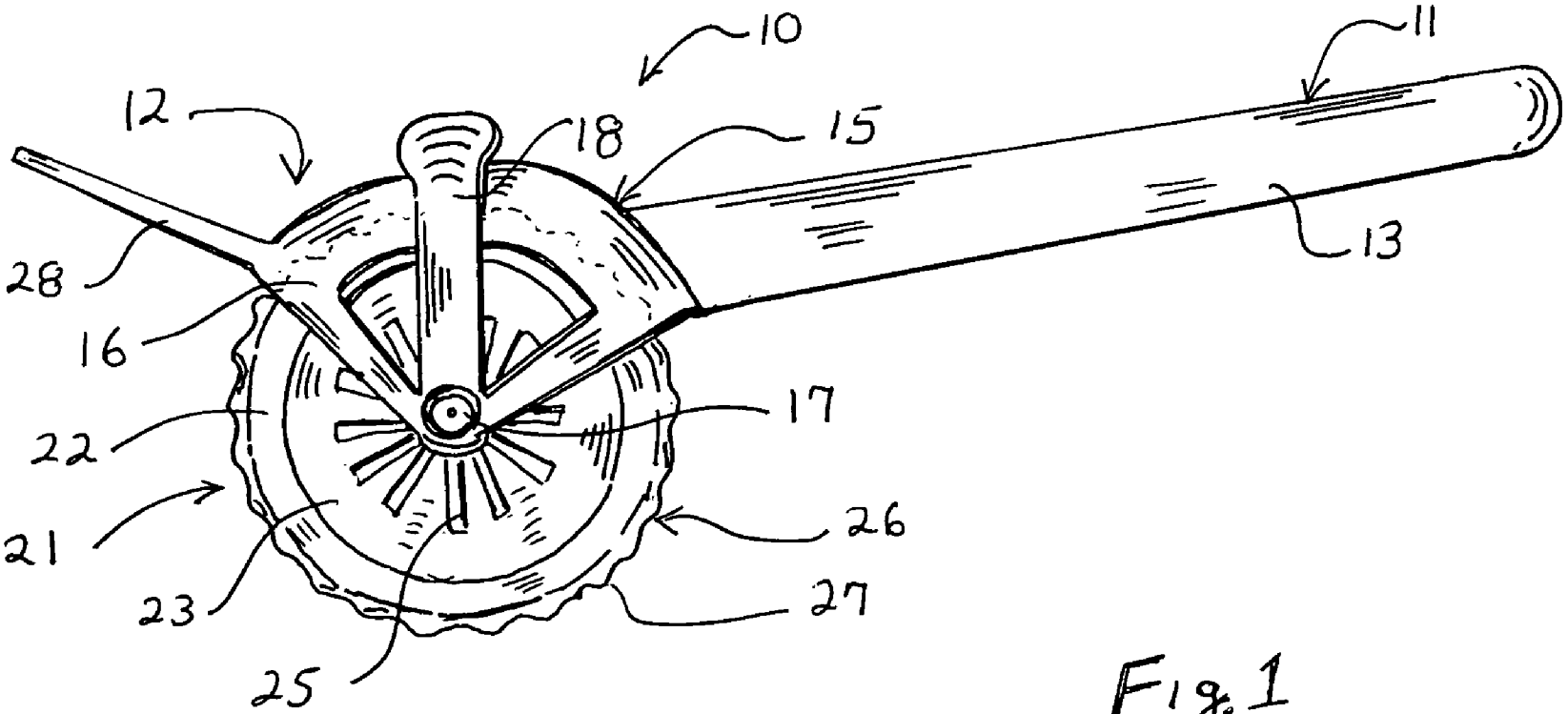
FIG. 1 is a side elevational view of the grill brush of the invention.
Figure 2:
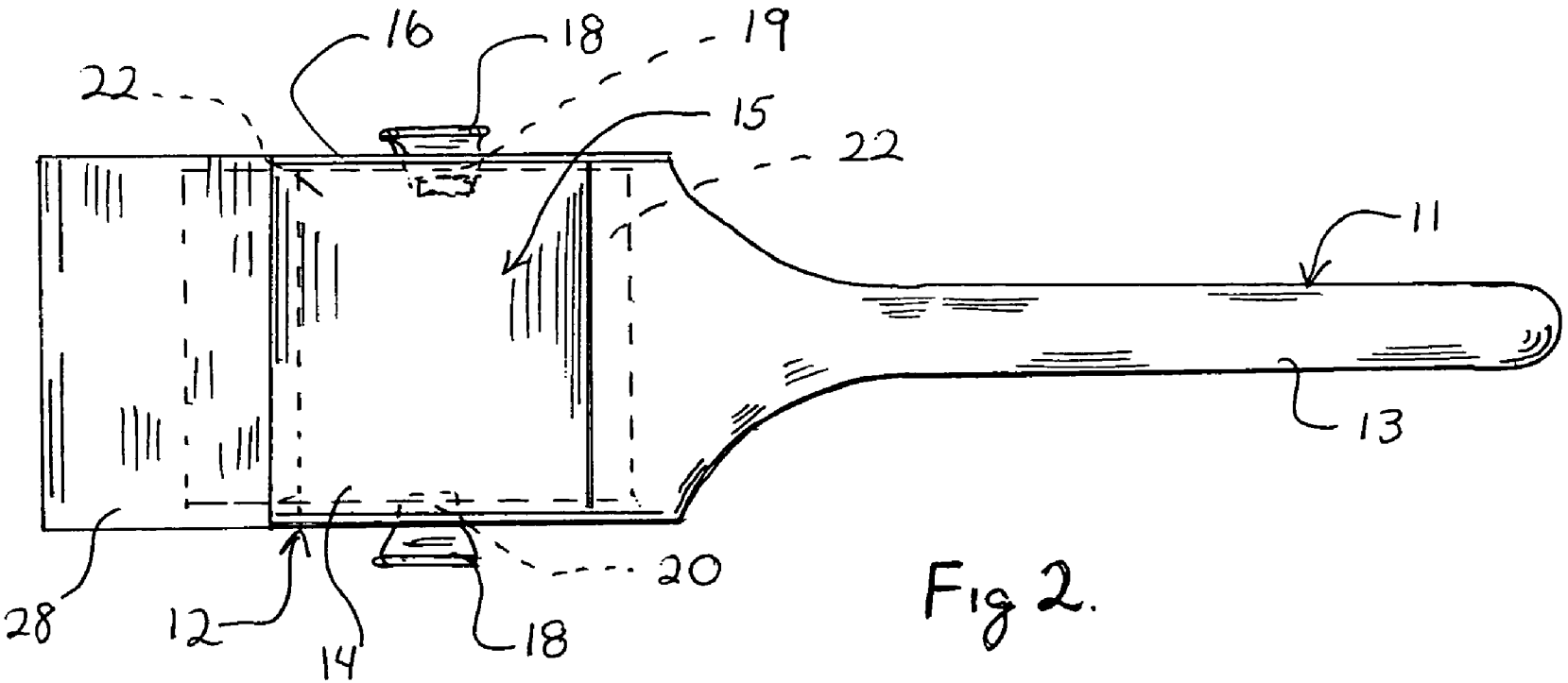
FIG. 2 is a top plan view thereof.

Referring to FIG. 1 of the drawings, a grill brush 10 of the invention can be seen having a handle portion 11 and a brush support portion 12. The handle portion 11 has an elongated cylindrical handle 13 integral with a brush housing 14 within the support portion 12. The brush housing 14 has a contoured top 15 with oppositely disposed depending arcuate sidewalls 16 from which extend support elements angularly towards a center apertured hub fittings 17.

Figure 4:
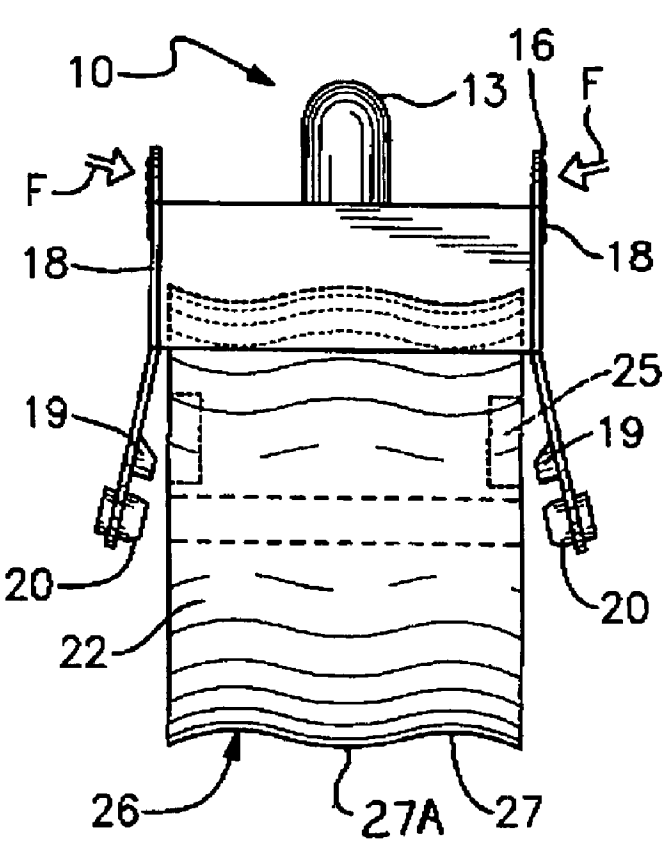
FIG. 4 is a front elevational view in access rotational index and cylinder brush removal position.
Figure 3:
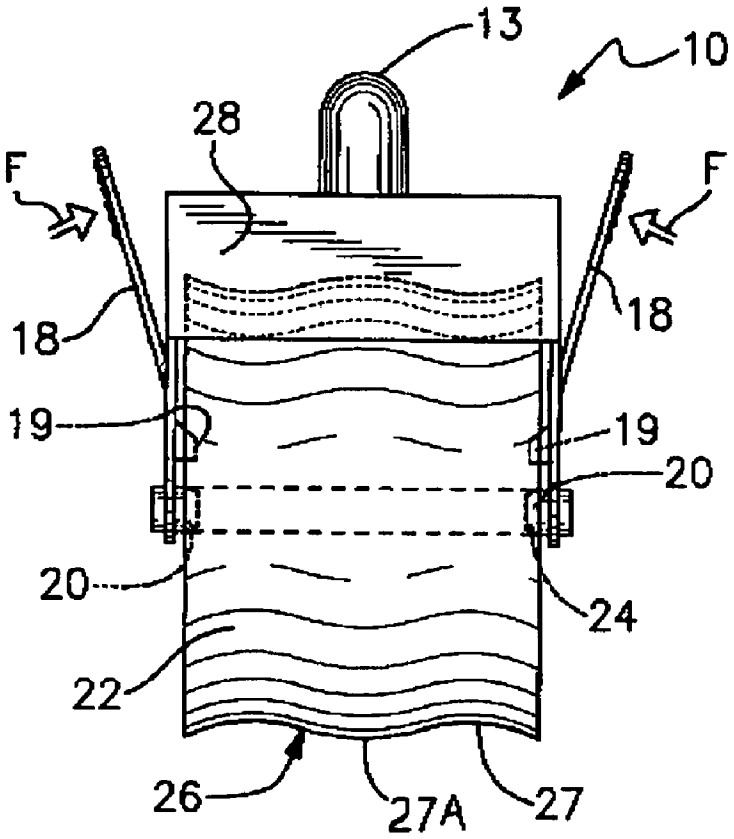
FIG. 3 is a front elevational view in operational position.

A pair of indexing wheel lock brackets 18 are interengaged therewith and provide for offset resilient displacement under manual force input as best seen in FIGS. 3 and 4 of the drawings. Each of the lock brackets 18 have indexing locking tabs 19 extending inwardly therefrom with axial elements 20 provided for rotational support of a cylindrical brush assembly 21. The brush assembly 21 has a main support body brush cylinder 22 with a pair of apertured indexing hubs 23 thereon. Each of the indexing hubs 23 are centrally apertured at 24 for registration of said respective hereinbefore described axial elements 20 on the locking brackets 18 allowing for rotation thereon.

The indexing hubs 23 have a plurality of radially extending spaced indexing engagement slots 25 aligned for selective registerable engagement with corresponding indexing locking tabs 19, as noted.

An outer surface of the cylinder 22 is of a transversely undulating configuration at 26 defining a pair of annular grooves 27 thereabout with corresponding raised ridge 27A. The outer cylinder surface as hereinbefore described is formed of or covered with a metal scourer or scrubber material well adapted for grill cleaning within the art.

In use, the brush cylinder 22 is engaged on the grill surface (not shown) cleaning same by reciprocal motion thereover via the handle 13 by the user (not shown).

After applied use, the user can manually engage the respective indexing locking brackets 18 at their respective angular disposed free ends, illustrated by force arrows F displacing same and disengaging the respective indexing locking tabs 19 allowing the cylinder 22 to rotate on the axles 20 repositioning same to a new and unused scouring surface material.

It will be evident that continued depression of the locking index tabs 19 will allow the cylinder brush 22 insert to be removed from and replace in the brush housing.

A scraper element 28 is also provided extending from the front of the brush housing 14 in oppositely disposed relation to the integral handle 13. The scraper element 28 is integral with the brush housing and is angularly offset so as to be well positioned for inversion and use on the grill surface, (not shown) by handle force manipulation.

It will thus be seen that a new and novel grill cleaning brush has been illustrated and described showing unique cylindrical brush surface which can be indexed and repositioned so that new unused surface portions can be engaged upon the grill. Additionally, the brush cylinder 22 can be removed and replaced after extended use.

It will be apparent to those skilled in the art that various changes and modifications may be made thereto without departing from the spirit of the invention.

Therefore I claim:

1. A tool for cleaning a grill comprises, a brush housing, a handle extending from the housing, brush indexing and rotating support brackets resiliently positioned on said housing, a brush wheel, aperture indexing hubs on said brush wheel, locking tabs on said respective support brackets aligned for selective registration with said aperture index hub for incrementally rotating said brush wheel within said housing, a scraper extending away from and in spaced relation to said brush wheel extending from said housing in oppositely disposed relation to said handle, and a plurality of translateral continuous interconnected undulating brush surfaces defining a pair of annular spaced parallel grooves thereabout.

2. The tool for cleaning a grill set forth in claim 1 wherein said aperture index hub has radially spaced apertures on said hub's oppositely disposed surfaces.

3. The fool for cleaning a grill set forth in claim 1 wherein said scraper is angularly disposed in relation to said housing, a blunt end edge on said scraper surface in spaced relation to said housing.

* * * * *